US007014579B1

(12) United States Patent
Sung

(10) Patent No.: US 7,014,579 B1
(45) Date of Patent: Mar. 21, 2006

(54) SHOCK ABSORBING DEVICE FOR RACKET

(76) Inventor: Hung-Fu Sung, No. 17, Lane 210, Chung Yang Rd., Feng Yuan, Taichung Hsien (TW) 420

( * ) Notice: Subject to any disclaimer, the term of this patent is extended or adjusted under 35 U.S.C. 154(b) by 0 days.

(21) Appl. No.: 10/961,100

(22) Filed: Oct. 12, 2004

(51) Int. Cl.
*A63B 49/00* (2006.01)

(52) U.S. Cl. ..... 473/522

(58) Field of Classification Search ..... 473/520–522, 473/543

See application file for complete search history.

(56) References Cited

U.S. PATENT DOCUMENTS

| | | | | | |
|---|---|---|---|---|---|
| 4,761,007 | A * | 8/1988 | Boschian | 473/522 |
| 4,909,509 | A * | 3/1990 | Boschian | 473/522 |
| 4,927,143 | A * | 5/1990 | Hillock | 473/522 |
| 4,948,131 | A * | 8/1990 | Nakanishi | 473/521 |
| 5,022,651 | A * | 6/1991 | Barone | 473/522 |
| 5,106,086 | A * | 4/1992 | Acosta | 473/522 |
| 5,792,011 | A * | 8/1998 | Kuebler | 473/520 |
| 5,871,409 | A * | 2/1999 | Kimoto | 473/522 |
| 5,964,672 | A * | 10/1999 | Bianchi | 473/521 |
| 6,033,324 | A * | 3/2000 | Nashif et al. | 473/520 |
| 6,447,411 | B1 * | 9/2002 | Bianchi | 473/522 |
| 6,755,756 | B1 * | 6/2004 | Sung | 473/522 |
| 2004/0023738 | A1 * | 2/2004 | Sung | 473/522 |

FOREIGN PATENT DOCUMENTS

| | | | |
|---|---|---|---|
| FR | 2554723 | A * | 5/1985 |
| GB | 2135588 | A * | 9/1984 |

* cited by examiner

*Primary Examiner*—Raleigh W. Chiu
(74) *Attorney, Agent, or Firm*—Bacon & Thomas, PLLC

(57) ABSTRACT

Provided is an elastomeric shock absorbing device mountable in a racket such as tennis racket. The device comprises a cylindrical first cushioning member including two annular flanges in its top and bottom respectively, an intermediate annular recess, a spherical chamber provided in its center, and a channel in communication between the top flange and the chamber; a plurality of elastomeric balls received in the chamber by putting into the channel; and a ring-shaped second cushioning member including an annular groove, the second cushioning member being adapted to mount around the recess, wherein three straight wires of a network of the racket pass three sides of the groove for fastening the shock absorbing device in an open space of the network. A number of embodiments are possible for the purposes of balance, decreasing reaction, and increasing strength in hitting a ball.

5 Claims, 8 Drawing Sheets

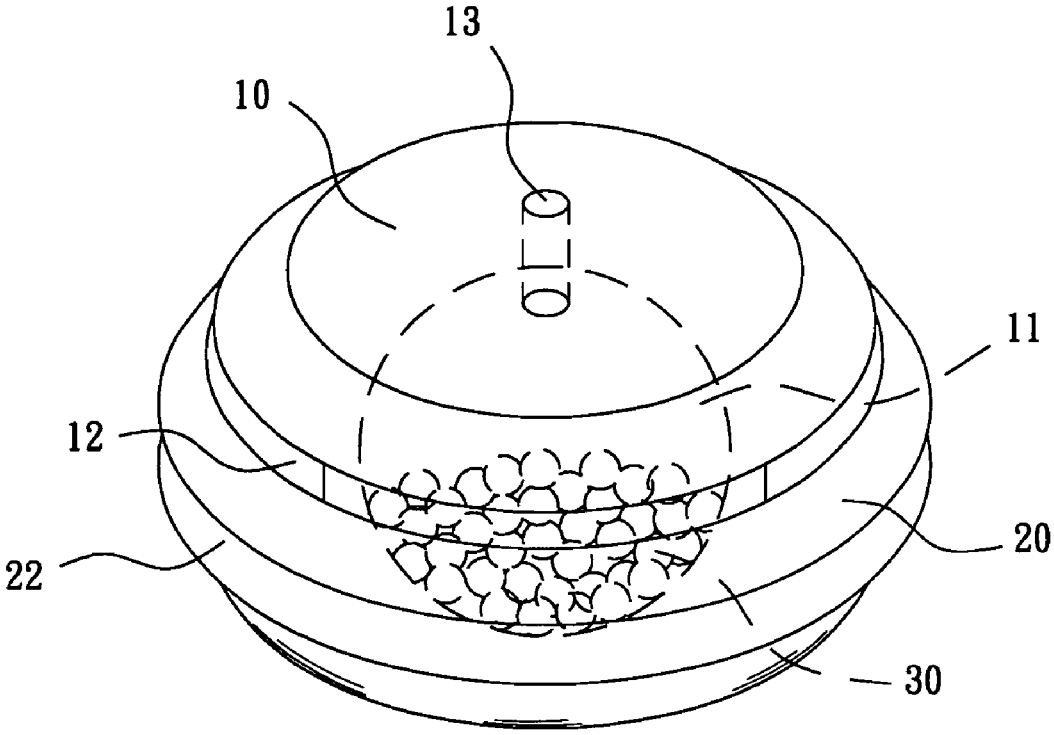
Fig・1

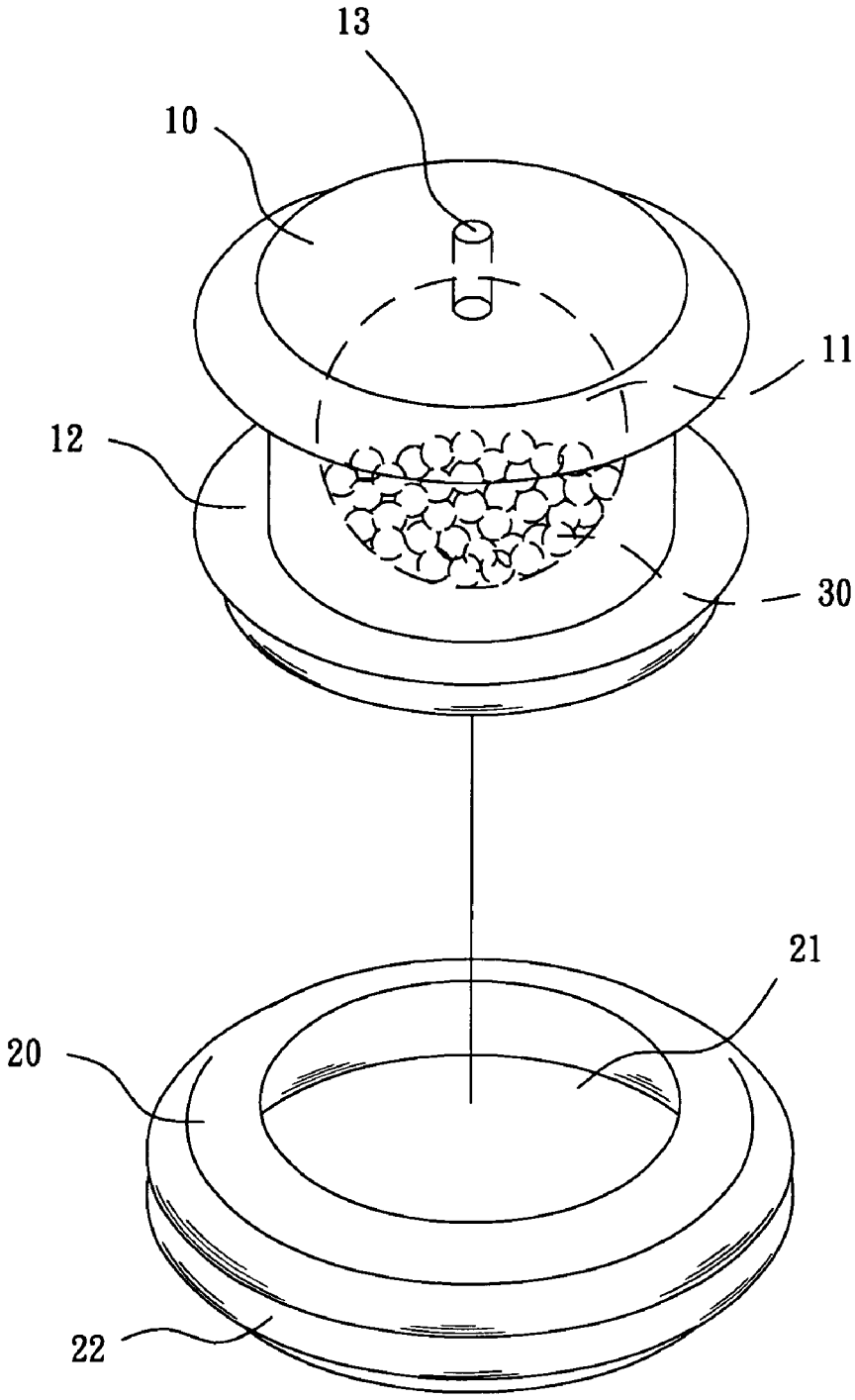
Fig・2

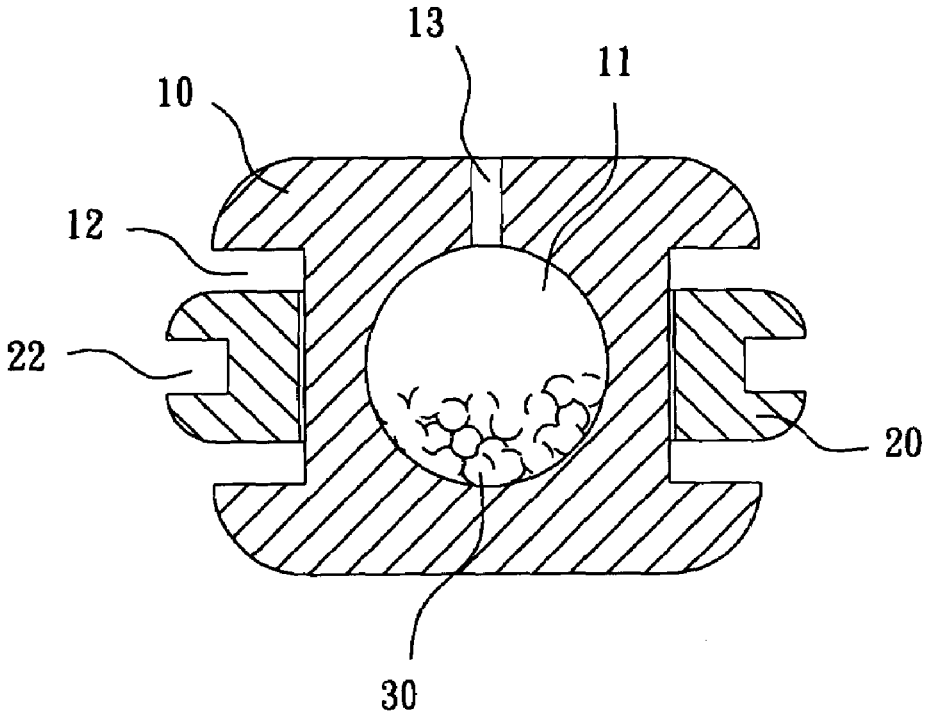
Fig • 3

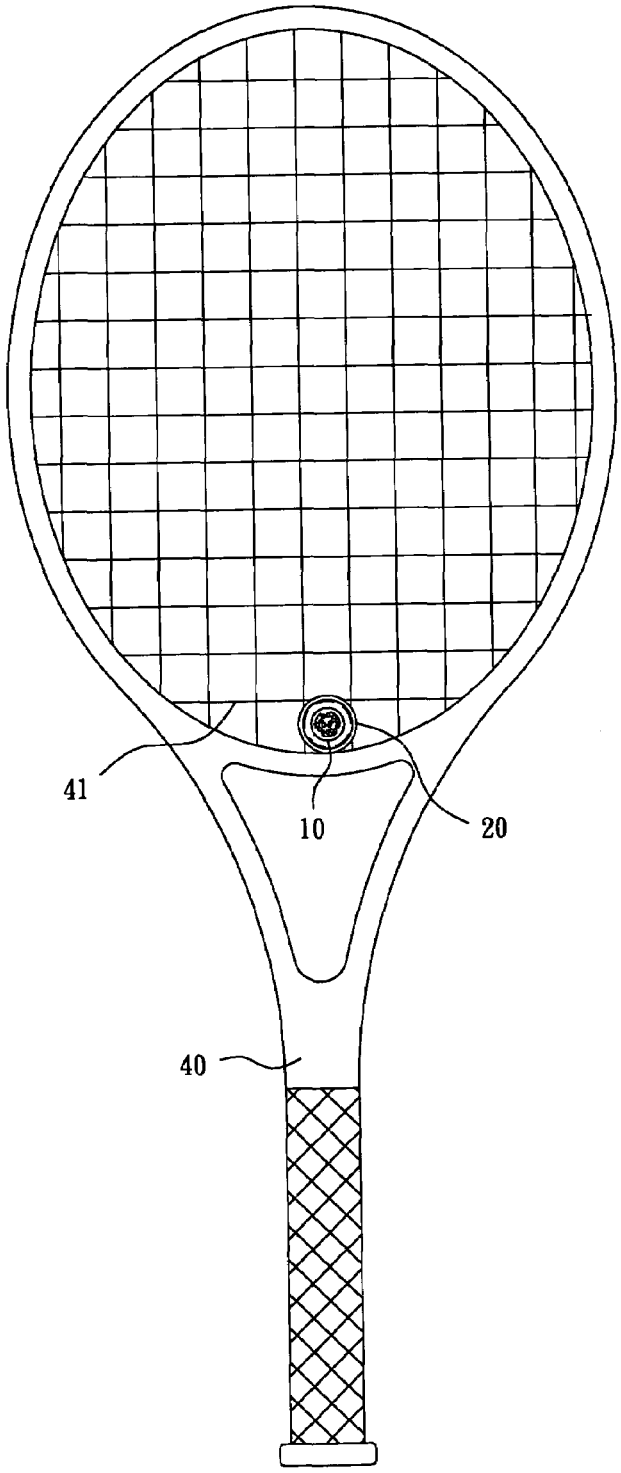
Fig・4

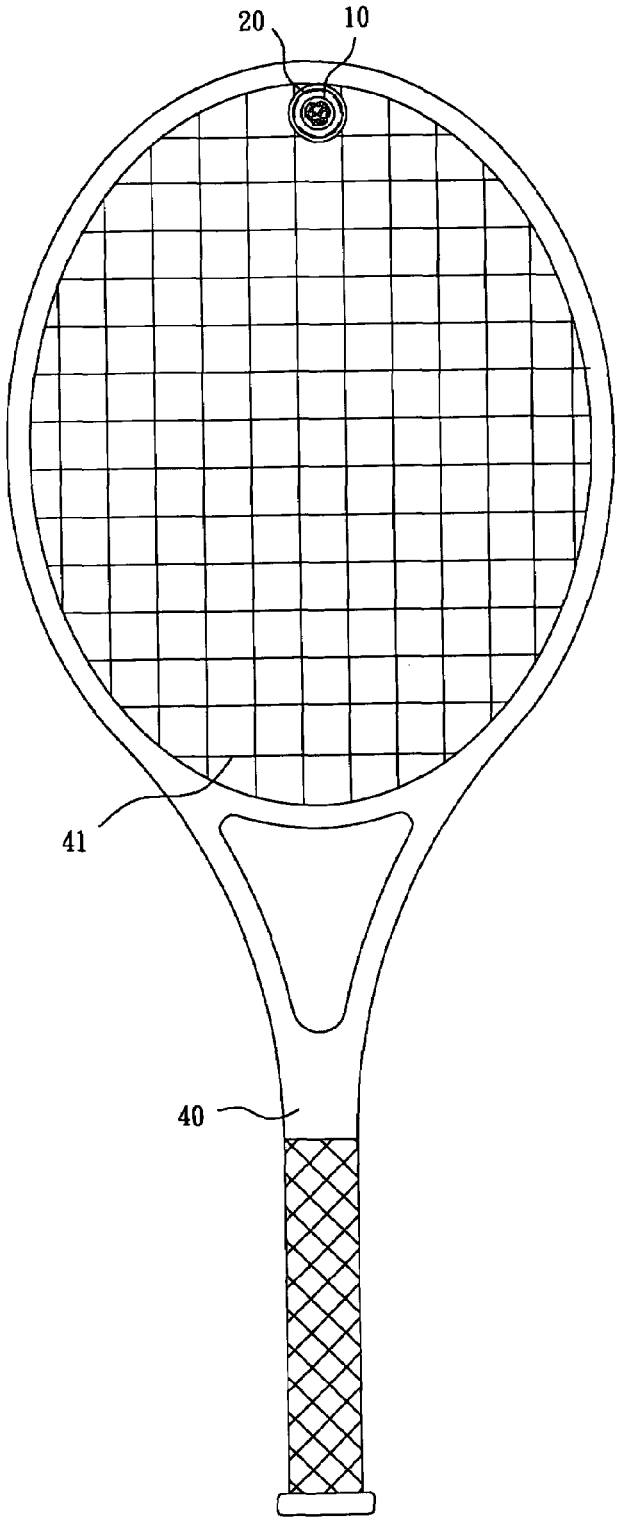
Fig・5

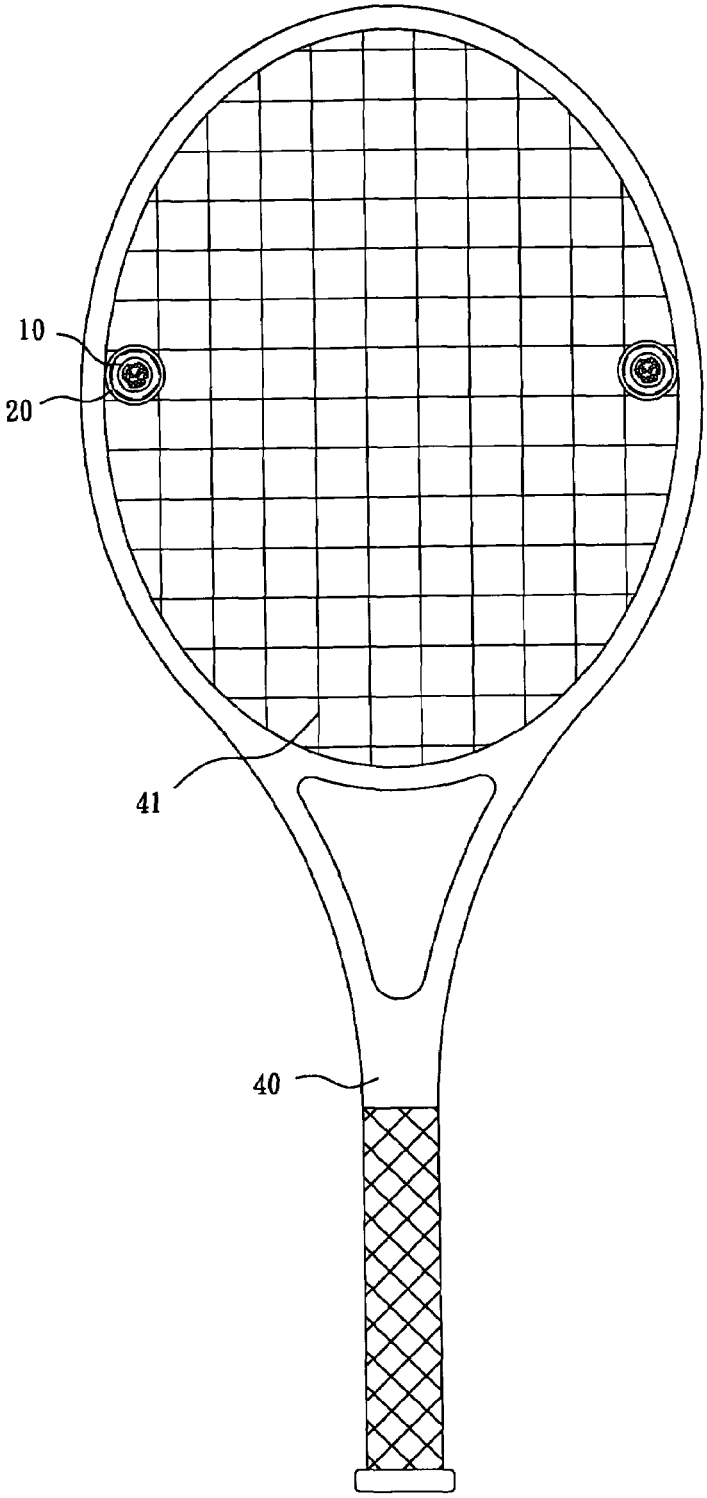
Fig • 6

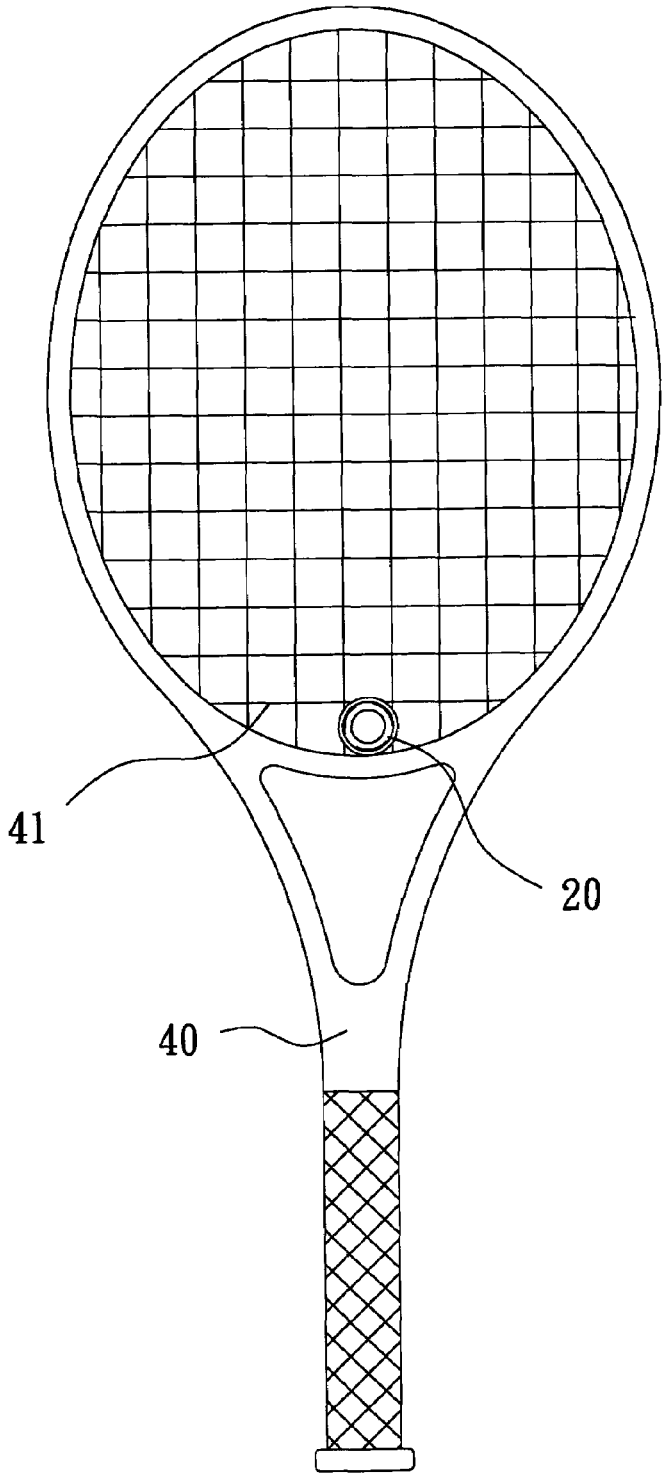
Fig・7

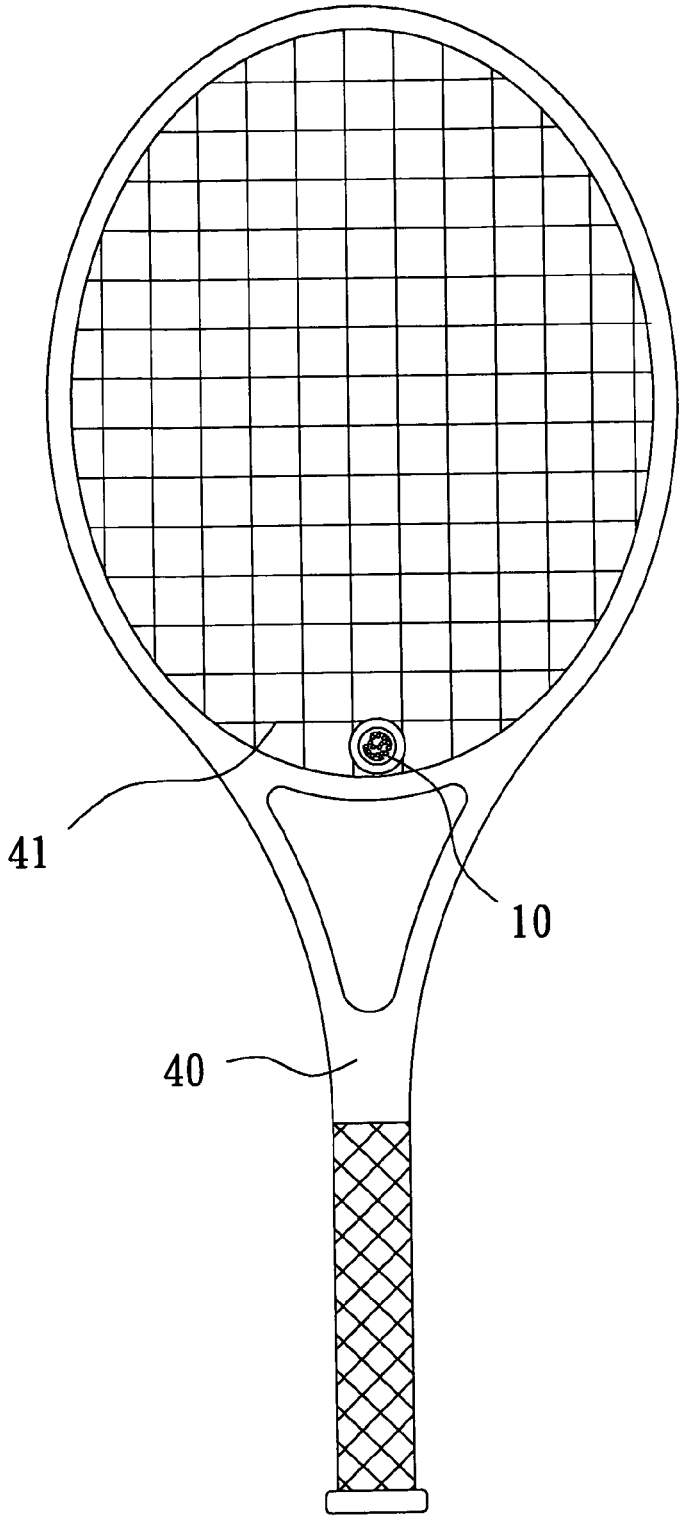
Fig・8

SHOCK ABSORBING DEVICE FOR RACKET

FIELD OF THE INVENTION

The present invention relates to rackets and more particularly to a tennis racket having one or two shock absorbing devices mounted in its network.

BACKGROUND OF THE INVENTION

It is known that the hand of a player (e.g., tennis player) may feel the strong force of shocks after hitting a ball. This is because reaction to the hitting transmits from the network of a racket to the hand holding the handle of the racket. As such, the player may feel a degree of discomfort.

A variety of shock absorbing devices have been developed and some of them are even realized by mounting in the network of a racket. However, as far as the present inventor is aware, nothing in these well known shock absorbing devices provides the benefits and advantages attendant with the present invention.

SUMMARY OF THE INVENTION

It is therefore an object of the present invention to provide an elastomeric shock absorbing device mountable in a racket, comprising a cylindrical first cushioning member including two annular flanges in its top and bottom respectively, an intermediate annular recess, a spherical chamber provided in its center, and a channel in communication between the top flange and the chamber; a plurality of elastomeric balls received in the chamber by putting into the channel; and a ring-shaped second cushioning member including an annular groove, the second cushioning member being adapted to mount around the recess, wherein three straight wires of a network of the racket pass three sides of the groove for fastening the shock absorbing device in an open space of the network.

In one aspect of the present invention, the shock absorbing devices are arranged in a pair in the network with a transverse distance therebetween being a maximum for the purpose of balance in hitting a ball.

In another aspect of the present invention, the shock absorbing device is provided in the network proximate a handle of the racket for the purpose of decreasing reaction in hitting a ball.

In a further aspect of the present invention, the shock absorbing device is provided proximate a tip of a frame of the racket for the purpose of increasing strength in hitting a ball.

The above and other objects, features and advantages of the present invention will become apparent from the following detailed description taken with the accompanying drawings.

BRIEF DESCRIPTION OF THE DRAWINGS

FIG. 1 is a perspective view of a shock absorbing device mountable in a racket according to the invention;

FIG. 2 is an exploded view of the shock absorbing device;

FIG. 3 is a sectional view of the shock absorbing device;

FIG. 4 is a first preferred embodiment of the invention where the shock absorbing device is provided in the network of a tennis racket proximate the handle thereof;

FIG. 5 is a second preferred embodiment of the invention where the shock absorbing device is provided in the network of the tennis racket distal the handle thereof;

FIG. 6 is a third preferred embodiment of the invention where the shock absorbing devices are arranged in a pair in the network of the tennis racket with a transverse distance therebetween being a maximum;

FIG. 7 is a fourth preferred embodiment of the invention where the second cushioning member is separate from the first cushioning member and is provided in the network of the racket proximate the handle thereof; and FIG. 8 is a fifth preferred embodiment of the invention where the separate first cushioning member is provided in the network of the racket proximate the handle thereof.

DETAILED DESCRIPTION OF THE PREFERRED EMBODIMENTS

Referring to FIGS. 1 to 3, there is shown a shock absorbing device mountable in a racket (e.g., tennis racket) in accordance with the invention. The shock absorbing device is formed of an elastomeric material and comprises a first cushioning member 10 and a second cushioning member 20. Each component will be described in detailed below.

The first cushioning member 10 is a cylindrical member and comprises two annular flanges in its top and bottom respectively, an annular recess 12 between the flanges, a spherical chamber 11 provided in its center, and a channel 13 in communication between an opening in the top flange and the chamber 11. A user may put a selected number of elastomeric balls 30 (i.e., depending on the desired shock absorbing effect) into the channel 13. The balls 30 then fall into the chamber 11 for receiving.

The second cushioning member 20 is a doughnut shaped member and comprises a central opening 21 and an annular groove 22. The second cushioning member 20 is adapted to mount around the recess 12 by putting it thereon because, as stated above, the shock absorbing device is formed of an elastomeric material. Note that the width of the recess 12 is slightly larger than the height of the second cushioning member 20 so that a degree of allowance can be given to the coupled second cushioning member 20 and the recess 12.

Referring to FIGS. 4 to 8, the shock absorbing device of the invention can be realized in a number of preferred embodiments as detailed below. The shock absorbing device is fastened in an open space of the network of, for example, nylon of a tennis racket with three straight wires 41 passing three sides of the groove 22 (see the first preferred embodiment of FIG. 4). The location of the shock absorbing device shown in FIG. 4 (i.e., proximate the handle 40 of the racket) is able to absorb much reaction when a ball is hit by the racket in a tennis game. As such, shock transmitted to the hand of a player holding the handle 40 is greatly reduced.

As shown in the second preferred embodiment of FIG. 5, the shock absorbing device is provided proximate a tip of the frame distal the handle 40. Such can increase the strength of ball hitting.

As shown in the third preferred embodiment of FIG. 6, the shock absorbing devices are arranged in a pair in the network of the racket in which a transverse distance therebetween is a maximum. Such can increase the balance of ball hitting.

Either first cushioning member 10 or second cushioning member 20 can be employed independently. For example, as shown in the fourth preferred embodiment of FIG. 7, the second cushioning member 20 is separate from the first cushioning member 10 and is located at a position proximate the handle 40 of the racket the same as that shown in FIG. 4. Also, as shown in the fifth preferred embodiment of FIG. 8, the first cushioning member 10 is located at a position proximate the handle 40 of the racket the same as that shown in FIG. 4.

While the invention herein disclosed has been described by means of specific embodiments, numerous modifications and variations could be made thereto by those skilled in the art without departing from the scope and spirit of the invention set forth in the claims.

What is claimed is:

1. A shock absorbing device mountable in a racket, comprising:

a cylindrical first cushioning member including two annular flanges in its top and bottom respectively, an intermediate annular recess, a spherical chamber disposed in its center, and a channel in communication between the top flange and the chamber;

a plurality of elastomeric balls received in the chamber by putting into the channel; and a ring-shaped second cushioning member including an annular groove, the second cushioning member being adapted to mount around the recess, wherein three straight wires of a network of the racket pass three sides of the groove for fastening the shock absorbing device in an open space of the network.

2. The shock absorbing device of claim 1, wherein the shock absorbing device is formed of an elastomeric material.

3. The shock absorbing device of claim 1, wherein the shock absorbing devices are arranged in a pair in the network with a transverse distance therebetween being a maximum.

4. The shock absorbing device of claim 1, wherein the shock absorbing device is disposed in the network proximate a handle of the racket.

5. The shock absorbing device of claim 1, wherein the shock absorbing device is disposed proximate a tip of a frame of the racket.

* * * * *